United States Patent [19]

Perr

[11] 4,395,979

[45] Aug. 2, 1983

[54] PRESSURE LIMITING HYDRAULIC TAPPET

[75] Inventor: Julius P. Perr, Columbus, Ind.

[73] Assignee: Cummins Engine Company, Inc., Columbus, Ind.

[21] Appl. No.: 221,765

[22] Filed: Dec. 31, 1980

[51] Int. Cl.[3] ..... F01L 1/34; F01L 1/24

[52] U.S. Cl. ..... 123/90.16; 123/90.57

[58] Field of Search ..... 123/90.16, 90.55, 90.56, 123/90.57, 90.58, 90.59, 90.46

[56] References Cited

U.S. PATENT DOCUMENTS

| | | | |
|---|---|---|---|
| 2,006,641 | 7/1935 | Johnson | 123/90.57 |
| 2,309,740 | 2/1943 | Voorhies | 123/90.57 |
| 2,833,257 | 5/1958 | Lengnick | 123/90.46 |
| 2,940,433 | 6/1960 | Randol | 123/90.55 |
| 3,385,274 | 5/1968 | Shunta et al. | 123/90.57 |

*Primary Examiner*—Craig R. Feinberg

*Assistant Examiner*—W. R. Wolfe

*Attorney, Agent, or Firm*—Neuman, Williams, Anderson & Olson

[57] ABSTRACT

A pressure limiting expandable hydraulic tappet is provided for use in an internal combustion engine to selectively vary timing by altering the effective profile of a camshaft. The tappet expands to extend the drive train between the camshaft and a camshaft operated mechanism by enlarging and filling an internal hydraulic chamber with a noncompressible hydraulic fluid via an inlet port. The fluid is retained in the tappet chamber by a control valve until a predetermined pressure is attained, when the valve control opens to exit the pressurized fluid through the inlet port and maintain said predetermined pressure for the duration of the camshaft stroke. The valve control means is responsive to the hydraulic pressure acting on an area differential within the chamber to overcome a selected bias.

20 Claims, 2 Drawing Figures

PRESSURE LIMITING HYDRAULIC TAPPET

BACKGROUND OF THE INVENTION

This invention relates to variable timing tappets for use in internal combustion engines. More specifically, it relates to pressure limiting tappets to vary the effective profile of a camshaft by hydraulically extending the drive train between the camshaft and a camshaft operated mechanism. Although hydraulic tappets are known in the prior art, they are not pressure sensitive, they rapidly collapse when the high pressure hydraulic fluid is vented, and they vent the fluid onto the engine block rather than confining it to the fluid supply system.

In an effort to maximize the efficiency and power output of diesel engines, as well as lower undesirable exhaust emissions, diesel engine manufacturers have sought a reliable and consistent means of altering the timing of injection and the opening and closing of cylinder valves. In a typical diesel engine, the injectors and valves are operated by a camshaft having a plurality of precisely defined lobe profiles radially located in a timed rotational relationship. Each lobe is connected to a camshaft operated mechanism, such as a valve or injector, by a suitable combination of mechanical links, including push rods, rocker arms, etc. However, such mechanical linkage results in a rigid timing program that cannot be altered while the engine is operating.

In the past, manufacturers have experimented with a variety of means to alter engine timing, but most have not proven successful. These efforts have included eccentric cam followers, gear phasers, overtravel tappets, helix combination injectors, hydraulic intensifiers, and variable task hydraulic tappets.

Prior art variable length hydraulic tappets have also been used to vary timing, but they have met only limited success. Hydraulic tappets are interposed between the camshaft and camshaft operated item and alter engine timing by selectively lengthening the timing drive train, thereby changing the effective profile of a camshaft. Typically, the collapsed or shortened tappet permits the camshaft operated item to operate in its normal timing sequence. When the tappet is lengthened, by trapping hydraulic (non-compressible) fluid in an internal tappet chamber, the drive train between the camshaft and camshaft operated item is lengthened, advancing the normal timing sequence. Conversely, such a tappet may be used to retard timing by selectively collapsing it to shorten the camshaft drive train.

However, these tappets suffer various deficiencies, including sensitivity to hydraulic fluid viscosity and engine speed, manufacturing tolerances, non-uniform pressure maintenance, failure to self prime from dry engine start up, irregular transient response, an excessive failure rate due to the high hydraulic pressures generated, and energy losses in the continued pumping of the hydraulic fluid. In addition, variable length hydraulic tappets are limited to use only where the camshaft operated item is not sensitive to increased pressure loading, cam link overtravel, and rapid tappet collapse. Thus, such prior art hydraulic tappets are unsuitable for use with highly loaded unit injectors and are restricted to use with camshaft operated valves for a variety of reasons. Specifically, camshaft link overtravel and increased injection camshaft pressure or train loads may burst the injector cup, reduce injection duration and throttle fueling in an advance mode. Also, rapid tappet collapse may interfere with a sharp, clean end of injection and permit hot exhaust gases to escape into the injector.

SUMMARY OF THE INVENTION

It is an object of the present invention to overcome the aforementioned difficulties and shortcomings of the prior art for selectively varying the effective profile of a camshaft to alter engine timing.

Another object of the invention is to provide a novel, reliable and simple apparatus for selectively altering the timing of internal combustion engines, including diesel fuel injection.

Still another object of the invention is to provide a hydraulic tappet that is pressure limiting, yet does not rapidly collapse when said predetermined pressure is attained, thus forming a "load cell".

These and other objects are obtained by providing a load limiting expandable hydraulic tappet for use in an internal combustion engine. The tappet selectively varies the effective profile of a camshaft by extending the drive train between the camshaft and a camshaft operated mechanism, and contracting when the drive train pressure reaches a predetermined maximum.

The tappet includes a body portion having a bore with a piston assembly disposed therein. The piston assembly includes a first piston disposed for reciprocal movement within the bore and forming a hydraulic tight seal therewith. The first piston has one portion connected to the camshaft and a second portion forming a chamber having an inlet port. A second piston is disposed within the chamber and forms a hydraulic tight seal therewith. The second piston is connected to a camshaft operated item and is reciprocally moveable within the chamber. A supply of hydraulic fluid is supplied to the inlet port and a valve is disposed in the port to seal the hydraulic chamber. The valve is controlled to selectively admit fluid to the chamber to expand the piston assembly, close and entrap the hydraulic fluid in the chamber, and open to exit hydraulic fluid back through the inlet port, whereby the piston assembly assumes a contracted mode.

DESCRIPTION OF THE DRAWINGS

All of the above is more fully explained in the detailed description of the preferred form of the invention which follows. This description is illustrated by the accompanying drawings wherein.

DESCRIPTION OF THE PREFERRED EMBODIMENT

While a specific preferred embodiment is disclosed herein, oriented in a preferred direction, it is understood that variations in configuration and orientation are within the scope of the present invention.

Figure 1:
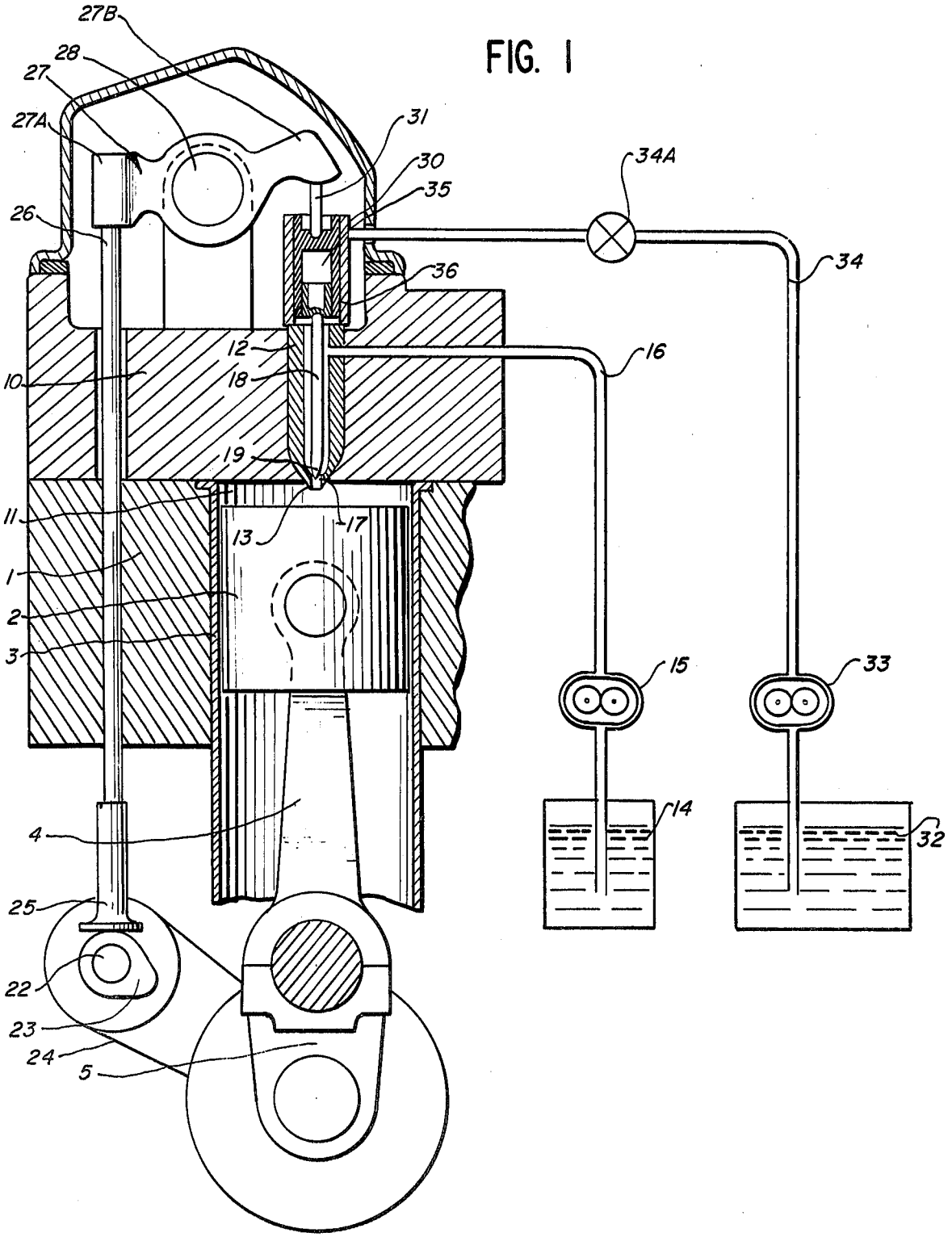
FIG. 1 is a schematic illustration of one cylinder of a diesel engine, partially in vertical section, illustrating the use of an expandable hydraulic tappet to vary the effective profile of a camshaft by extending the drive train between the camshaft and a camshaft operated fuel injector.

Referring to FIG. 1, a diesel engine includes a cylinder block 1 having a piston 2 reciprocally disposed within a piston liner 3 inserted into the cylinder bore of the block. A connecting rod 4 joins the piston 2 to the crankshaft 5.

A cylinder head 10, superposed and rigidly attached to the block 1, defines a compression chamber 11 above the piston bounded by the piston liner. A fuel injector 12 extends through the head 10 and has its tip or cup 13 disposed within the uppermost portion of said chamber 11. The exact configuration of injectors is well known in the art and, except as noted hereinafter, the design thereof is not necessary to an understanding of the present invention. Fuel 14 is supplied to the injector 12 by a suitable fuel pump 15 through a fuel line 16. The fuel enters the injector 12 and is metered by any well known means to the injector sack 17 in the injector tip 13. An internal reciprocating plunger 18 typically extends the length of the injector and has a point 19 that extends to the sack 17.

A camshaft 22 with a selected number of specially formed lobes 23 in a predetermined timed rotational relationship to one another is mounted for rotation in said block and connected to said crankshaft 5 by timing means 24 to maintain the two in a fixed timed relationship and coordinate the movement of the cam follower 25 and the piston 2. Said timing means may be gears, chains, or any other mechanism well known in the art. The cam follower 25 is rigidly connected to a push rod 26 for unitary movement therewith. A rocker arm 27 is rotationally mounted on a shaft 28, and has a first end 27A connected to the push rod 26 to transfer the reciprocal movement of the rod to a second end 27B of the rocker arm.

An expandably hydraulic tappet 30 and suitably long rocker link 31 as necessary are interposed between the second end 27B of the rocker arm 27 and the uppermost end of the injector plunger 18. Hydraulic fluid 32 is supplied to the tappet by a suitable pump 33 through a fluid line 34 and valve 34A. The fluid enters and exits the tappet 30 via the line to an internal hydraulic chamber 35 to expand or contract said chamber and reciprocally move a piston disposed within the chamber for reciprocal coaxial movement. (A more detailed description of the tappet is made in conjunction with FIG. 2). Said piston movement lengthens or shortens the length of the tappet to alter the length of the drive train between the camshaft 22 and the injector 12, thereby changing the camshaft profile and injector timing. The tappet may be located at any convenient location in the drive train.

When operating in the retarded mode the tappet acts as a solid link and does not affect the profile of the camshaft. Specifically, the crankshaft 5 and camshaft 22 rotate in fixed timed relationship with the reciprocal movement of the piston 2. When the camshaft-push rod-rocker arm-rocker link drive train is in its relaxed mode, as illustrated (i.e. the camshaft follower 25 is not raised by camshaft lobe 23), the injector plunger 18 is in its retracted or raised mode. During this time, fuel 14 is metered into the injector with a predetermined amount pooling in the injector sack 17. Continued rotation of camshaft lobe 23 causes it to bear against the camshaft follower 25 and the aforementioned drive train depresses the tappet 30, acting as a solid link, against the injector plunger 18. The plunger point 19 moves into the sack 17 and thereby injects, under high pressure (approximately 3,000 p.s.i.), the metered fuel into the combustion chamber 11 through sprayholes 13. The plunger is maintained in its depressed position for a predetermined duration and under a predetermined pressure depending upon the configuration of the camshaft lobe 23.

When it is desirable to advance injection timing the tappet is expanded hydraulically to lengthen the aforementioned drive train, thereby selectively altering the camshaft profile. In operation, beginning with the relaxed drive train mode, hydraulic fluid 32 is metered into the tappet hydraulic chamber 35 via line 34 and valve 34A to expand the chamber and extend the piston 36. As noted earlier, continued rotation of the camshaft lobe 23 causes it to depress the injector plunger 18; however, due to the expanded tappet and lengthened drive train, the injector plunger 18 will experience excessive travel and pressure, tending to burst the fuel sack 17 and destroy the injector 12, unless the tappet 30 contracts to its relaxed position following injection of the fuel and seating of the plunger tip in the fuel sack. Moreover, unless the plunger is maintained in its depressed position for said predetermined duration and under said predetermined pressure, combustion gases may escape into the fuel sack 17 or the injector may dribble fuel after injection rather than have a sharp injection cut-off. Either of these conditions is unacceptable.

Applicant's novel invention provides means for overcoming these problems by exiting the pressurized hydraulic fluid, from the tappet chamber 35 to the supply line 34 in response to the pressure generated within the chamber by the continued movement of the drive train. This causes the tappet to contract yet maintain a relatively steady predetermined pressure against the injector plunger, as desired for optimum diesel operation. When properly designed, camshaft rotation pressures will collapse the tappet to its relaxed or retracted state during each cycle. Thus, advanced or retarded mode operation may be selected for each cycle.

Figure 2:
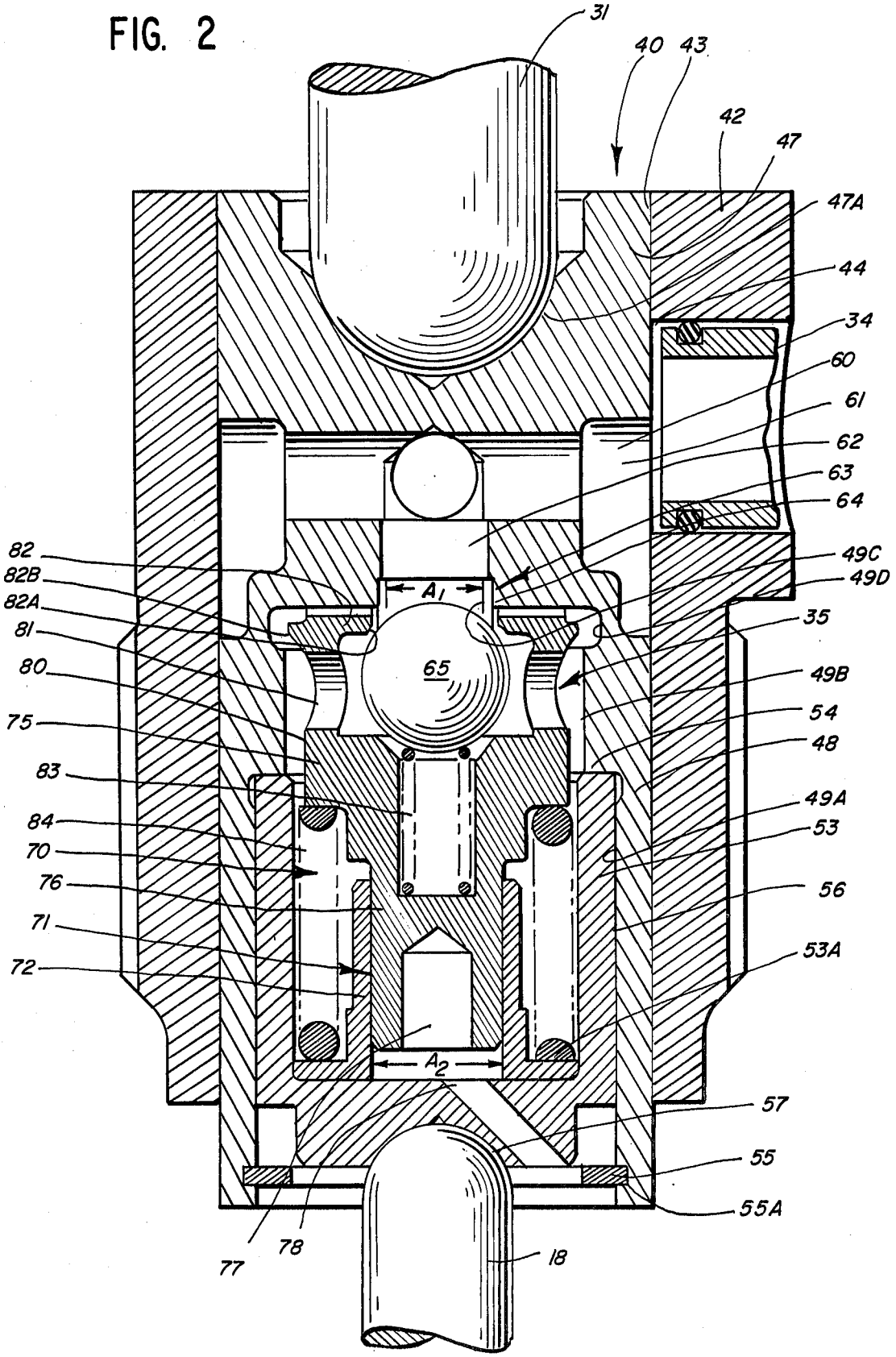
FIG. 2 is a cross-sectional view of the expandable hydraulic tappet of the present invention shown in a contracted state.

The detailed operation of applicant's pressure limiting tappet is explained with reference to FIG. 2. A tappet housing 42 has a cylindrical bore 43 and an orifice 44 connected to a supply of hydraulic fluid 34. Said hydraulic fluid may be engine oil or fuel oil at conventional pressure circulated in any known manner. The tappet housing 40 may be connected to a cylinder head or injector adapter and is typically interposed between a first link 31 to a camshaft or rocker arm (not shown) and a second link 18 to an injector plunger or other camshaft operated mechanism (not shown).

A cylindrical first piston 47 is disposed within said tappet housing 42 for reciprocal axial movement. The upper portion 47A is dished or concave to removably receive said first link 31. The lower skirt portion 48 defines an internal coaxial cylindrical chamber 35 having a lower piston liner portion 49A and an upper chamber portion 49B having an internal groove 49D at the top thereof. Reciprocal movement of the first piston 47 within the housing is limited by the slack or lash in the drive train. Alternatively, this movement may be constrained by a protrusion into the bore, such as a boss or annular protrusion. Such means are well known to those skilled in the art and have been omitted from the drawing for clarity.

A second piston 53 is disposed within said piston liner 49A for reciprocal axial movement between a stop ring 55 fixed into a mating annular groove 55A at the lowermost skirt of the piston liner portion 49A and a shoulder 54 within said chamber 35. The piston 53 forms a hydraulic tight seal at the interface 56 between its outermost surface and the piston liner portion 49A. The outer bottom portion 57 of the piston 53 is also dished or concave to removably accommodate the end of second link 18. The piston 53 has an interior cup-like recess 53A to define the lower portion of said hydraulic chamber 35.

An inlet port 60 includes an annular groove 61 around the periphery of the first piston 47 mediate the upper and lower portions and transverse to the bore axis. The shape of the groove may be chosen as desired provided that any movement of the piston 47 with respect to the housing 42 will not throttle the supply of hydraulic fluid from the passage 44. The groove 61 communicates with the hydraulic chamber via a tube or drilling 62 and a valve 63 disposed at the single chamber opening 49C. The interior cross-sectional area of the opening at the entrance to the chamber is $A_1$. The valve comprises a seat 64 and ball 65. Any preferred valve design and means to connect the supply of hydraulic fluid to the chamber may be substituted.

Disposed within the chamber 35 is a load cell 70 that controls the operation of the valve 63 and expands the chamber by moving the piston 53 outwardly. A plunger guide means 71 having a guide tube 72 coaxial with the tappet is disposed within the cup-like recess 53A and is seated on the bottom thereof. The interior cross-sectional diameter of the tube 72 is $A_2$.

A plunger 75 has a lower portion 76 slideably disposed within said guide tube 72 for coaxial hydraulically sealed movement with respect to the guide 71. The volume 77 defined by the piston 53, guide tube 72 and lower plunger portion 76 is vented to ambient pressure via the port 78. The upper plunger portion comprises a valve control means including a cage portion 80 for the ball 65 and apertures 81 to permit the hydraulic fluid to enter the cage and surround the ball. The cage includes an upper plate 82 disposed at the top of the chamber 35 adjacent the groove 49D. A central internal opening 82A therein has a diameter large enough to permit the hydraulic fluid to flow through the opening between the plate 82 and the ball, yet smaller than the diameter of the ball 65. The periphery 82B of the plate is chamfered to form a flow restricting passage between said periphery and chamber groove 49D when the plunger moves towards the piston 53. An expansion coil valve spring 83 between the ball 65 and plunger 75 biases the ball against the seat 64 to close the valve 63 when the plunger is in its upper position as shown. An expansion coil pumping spring 84 between the plunger guide 71 and plunger 75 urges the plunger guide and piston 53 to move coaxially away from the plunger 75 within the chamber so as to extend the piston assembly.

During operation in the retarded mode, the piston assembly is contracted to maintain a shortened drive train between the camshaft and injector or other device. The valve 34A of FIG. 1 is closed reducing the pressure of the hydraulic supply at orifice 44 to zero or near zero. Absent this upstream pressure at the valve 63, valve spring 83 maintains the ball 65 against the seat 64 to seal the chamber and block the entry of any fluid thereinto. As the camshaft profile moves to its relaxed mode, i.e. the camshaft lobe 23 is not exerting pressure against the camshaft follower 25, as shown in FIG. 1, the pumping spring urges the plunger 75 to the top of the chamber 35 and the plunger guide 71 and piston 53 downward against the stop ring 55, thereby expanding the chamber and likewise extending the piston assembly its full length. A light negative pressure is created in the chamber because it is sealed; however, the force of the valve spring 83 is sufficient to maintain the ball in sealing relation against its seat. As the camshaft rotates to its operating mode, lobe 23 exerts upward pressure on the follower 25 and in turn downward pressure on link 31. The latter pressure overcomes the force of the spring 84, causing the piston assembly to collapse and assume its shorter retracted length until the second piston 53 rests against the shoulder 54. When the piston components are in contact with one another in this manner they act as a solid link. Thus, in the retarded mode, the tappet has no effect on engine timing and merely acts as a lash adjuster.

During operation in the advanced mode, the tappet piston assembly is expanded so as to lengthen the drive train. Beginning with the piston assembly in a compressed or collapsed state, the valve 34A of FIG. 1 is opened pressurizing (i.e. approximately 15 p.s.i.) the hydraulic fluid in line 34. The pressurized hydraulic fluid flows from line 55 to the groove 61 and through tube 62 to valve 63. The force created by the upstream pressure of the hydraulic fluid over the area $A_1$ is greater than the force of the valve spring 83, thereby unseating the ball 65 and permitting the fluid to enter the chamber 35. While the camshaft profile is in its relaxed mode, the pumping spring again separates the piston components, extending the piston assembly and allowing the chamber to fill with hydraulic fluid. As the camshaft rotates to its operating mode (i.e. lobe 23 engages follower 25) and exerts pressure on the drive train, the pressure of the hydraulic fluid in the chamber is rapidly and significantly increased above the force of the valve spring 83, causing the valve 63 to close as a result of this downstream pressure and prevent fluid from escaping the chamber. The trapped fluid is incompressible resulting in the tappet piston assembly functioning as a solid link in the drive train. By reason of this sequence of events, the injector plunger 18 starts its downward movement sooner than normal, thus advancing fuel injection into the combustion chamber 11. The amount of advance is dependent upon the amount the piston assembly is extended.

As the injection drive train load increases the two pistons 47 and 53 are compressed, thereby increasing the hydraulic pressure within the chamber 35. The hydraulic pressure acting on the area $A_2$ creates a force urging the plunger downward against the pumping spring 84. As the chamber pressure continues to rise the force urging the plunger downward overcomes the pumping spring force, resulting in plunger 75 moving downward toward piston 53, moving with it the cage portion 80, until the upper cage opening 82 contacts and seals against the ball 65. The chamber pressure required for this first plunger movement is a function of the area $A_2$ and the force of the pumping spring 84 at maximum lash. Thus:

$$\text{Pressure required for initial plunger downward movement} = \frac{\text{Spring force at maximum lash}}{A_2}.$$

The hydraulic pressure within the chamber also acts on the area $A_1$ and creates a force urging the ball upward against its seat 64. (The force of the valve spring 83 is disregarded because it is insignificant with respect to the force resulting from the chamber hydraulic pressure.) The impact force of the plunger 75 meeting the ball 65 is low enough to prevent the ball from unseating momentarily and releasing trapped oil.

The plunger 75 and ball 65 now act as an integral unit with respect to further downward plunger movement. As the chamber pressure increases further (i.e. when the injector plunger 18 hits the cup), the pressure in the chamber rises until the force generated by the pressure against area $A_2$ overcomes the combined forces of the pressure against area $A_1$ and the pumping spring. As a result, the plunger moves further downward, unseating ball 65. Thus, the chamber pressure required for this second plunger movement is a function of the differential area $A_2$ minus $A_1$:

$$\text{Pressure required for initial valve opening} = \frac{\text{Spring force} - \text{chamber pressure } (A_1)}{A_2 - A_1}.$$

Opening of the valve exits high pressure hydraulic fluid out the inlet at a predetermined rate and back to its source. Since the hydraulic oil exits back to the inlet, the work to operate the tappet is minimized. Although a controlled leakage is desireable to assist in cooling the tappet, oil flow requirements are a function of leakage, not lash settings. The high pressure fluid will continue to exit provided the chamber pressure remains sufficiently high. As the cam lobe reaches its peak, the tappet maintains the desired predetermined pressure, exiting the high pressure hydraulic fluid from the chamber until the tappet reaches its collapsed state. It is now in a position to begin the cycle anew. In order to prevent too rapid load collapse during blowdown, which might permit the injector plunger to prematurely withdraw from the injector tip, fluid exit flow is restricted as the chamfered edge 82B approaches the lower edge of groove 49D, restricting the flow area. This prevents excessive plunger downward movement and may be accomplished by any number of alternative flow throttling designs. On the other hand, if the pressure drops too low, the force of the differential area $A_2$-$A_1$ will be insufficient to overcome the force exerted by the pumping spring, thereby raising the plunger and reseating the ball 65 until the pressure rises to a level sufficient to reopen the valve.

The tappet of the present invention senses only the force or load transmitted and limits said force to a predetermined maximum. Moreover, the force transmitted by the tappet may be altered as necessary or desireable by changing the differential area $A_2$ minus $A_1$ and the force of the pumping spring 84. In addition, such a system is insensitive to viscosity, may result in more uniform or increased injection pressure, provides a clean and sharp end of injection, has acceptable injector plunger-cup impact, exhibits no increase in drive train loads, eliminates sudden load collapse which might permit combustion gases to escape or fuel to dribble, permits timing alterations at any engine speed and load, allows relatively light spring pressure, operates independently of the input hydraulic fluid pressure, and results in longer life of the inlet valve because ball movement is controlled.

With the benefits of applicant's disclosure, it is apparent that substitutions and modifications may be made to vary the configuration of the valve, plunger, piston, etc. However, each of these changes are included within the scope of the invention as defined by the following claims.

What is claimed is:

1. A pressure limiting expandable hydraulic tappet for use in an internal combustion engine to selectively vary the effective profile of a camshaft by extending the drive train between said camshaft and a camshaft operated mechanism, said tappet comprising:

a housing having a bore therein;

a body portion disposed within said housing bore and having a first end operatively connected to a camshaft, a second end including means forming a hydraulic chamber, and an inlet-outlet port communicating said chamber to a portion of said body mediate said first and second ends, said inlet-outlet port having cross-sectional area $A_1$ where it enters said chamber;

a piston disposed within said chamber and forming a hydraulic-tight seal therewith, said piston having a first end operatively connected to the camshaft operated mechanism and being selectively reciprocally moveable within said chamber;

a supply of low pressure hydraulic fluid connected to said inlet-outlet port;

a valve disposed at said inlet-outlet port communicating said inlet-outlet port to said hydraulic chamber;

first valve control means for selectively opening or closing said valve, said first valve control means opening said valve to admit said hydraulic fluid into said chamber and effect independent relative movement of said piston within said chamber away from said first end of said body portion whereby the body portion and piston assume an expanded mode, and closing said valve to entrap the fluid within the chamber whereupon said body portion and piston while in an expanded mode move within the bore as a unit when the camshaft imposes a predetermined pushing force on said body portion; and second valve control means disposed within said chamber for selectively opening and closing said valve, said second valve control means having a portion with a cross-sectional area $A_2$ and being responsive to an increase in hydraulic pressure to a predetermined high level within said chamber whereupon the area differential $A_1$-$A_2$ creates a force to open said valve to exit said high pressure hydraulic fluid from said chamber out said inlet-outlet at a predetermined rate and effect independent relative movement of said body portion and said piston toward one another whereby the two assume a contracted mode.

2. The tappet of claim 1 wherein said second valve control means comprises:

a plunger guide means in contact with said piston, a plunger having its lower portion slideably disposed within and guided by said guide means for coaxial hydraulically sealed movement with respect to said body portion, said lower portion having a cross-sectional area $A_2$, and bias means urging said plunger guide and piston to separate from said plunger within said chamber to longitudinally extend said tappet.

3. The tappet of claim 2 wherein one side of said area $A_2$ is vented outside said chamber to normal pressure.

4. A tappet as in claim 2 wherein said body portion is cylindrical.

5. A tappet as in claim 2 wherein said piston is generally cup-shaped.

6. A tappet as in claim 2 wherein said plunger guide is disposed at least in part within said piston cup.

7. A tappet as in claim 2 wherein said valve comprises a spherical ball and mating seat, said ball biased towards said seat by an inlet spring.

8. A pressure controlled expandable hydraulic tappet for use in an internal combustion engine to selectively vary the effective profile of a camshaft by extending the drive train between said camshaft and a camshaft operated mechanism, said tappet comprising:

a housing having a bore therein;

a piston assembly disposed within said bore and having a first piston component disposed for reciprocal movement within said bore and forming a hydraulic-tight seal therewith, said first component having a first portion operatively connected to the camshaft and a second portion having an internal elongated chamber therein having a single inlet-outlet port, and a second piston component disposed within said chamber and forming a hydraulic-tight seal therwith, said second component being operatively connected to the camshaft operated mechanism and being selectively reciprocally moveable within said chamber, a supply of selectively pressurizeable hydraulic fluid connected to said inlet-outlet port, valve means disposed at said inlet-outlet port and spring biased to assume a closed position to seal said chamber, said valve opening to admit said hydraulic fluid into said chamber and effect independent relative movement of said piston components away from one another when a predetermined first valve opening force is exerted on said valve means, said valve means closing and entrapping said fluid within said chamber when a valve closing force exceeds said first valve opening force, and said valve means opening away from the inlet-outlet port to exit said hydraulic fluid from said chamber through said inlet-outlet port and effect independent relative movement of said first and second piston components toward one another when a predetermined second valve opening force is exerted on said valve, said second valve opening force being a function of hydraulic pressure within said chamber.

9. The tappet of claim 8 wherein said chamber comprises a lower skirt portion of said first piston component.

10. The tappet of claim 8 wherein said inlet-outlet port extends from said chamber to substantially the peripheral midportion of said first piston component.

11. The tappet of claim 8 wherein said hydraulic chamber has a predetermined configuration.

12. The tappet of claim 8 wherein said second piston component has a generally cup-like configuration.

13. The tappet of claim 8 wherein said first valve opening force is a function of the pressure of said hydraulic fluid supply, a preselected bias to close said valve, and the pressure within said hydraulic chamber.

14. The tappet of claim 8 wherein said valve closing force is a function of a preselected bias to close said valve and the pressure within said hydraulic chamber.

15. The tappet of claim 8 wherein said hydraulic fluid exits said chamber back through said inlet-outlet port to said supply means.

16. The tappet of claim 8 wherein a maximum tappet pressure between said camshaft and said camshaft operated mechanism is not exceeded.

17. The tappet of claim 8 wherein said first valve opening force is exerted upon said valve means by said supply of hydraulic fluid.

18. The tappet of claim 8 wherein said valve closing force is exerted upon said valve means substantially entirely by said fluid entrapped within said chamber.

19. The tappet of claim 8 wherein said supply of hydraulic fluid is a low pressure supply.

20. The tappet of claim 6 wherein said second valve opening force is a function of the pressure within said chamber acting upon a differential area to overcome a selected bias.

* * * * *